US006018355A

United States Patent [19]

Kuwabara

[11] Patent Number: 6,018,355

[45] **Date of Patent: *Jan. 25, 2000**

[54] THERMAL RECORDING APPARATUS

[75] Inventor: Takao Kuwabara, Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/808,860

[22] Filed: Feb. 28, 1997

[30] Foreign Application Priority Data

Feb. 29, 1996 [JP] Japan ..... 8-042969

[51] Int. Cl.[7] ..... B41J 2/36

[52] U.S. Cl. ..... 347/188; 347/183; 347/194

[58] Field of Search ..... 347/183, 184, 347/194, 188; 400/120.07, 120.13, 120.14; 358/461, 503

[56] References Cited

U.S. PATENT DOCUMENTS 5,838,342 11/1998 Takahashi et al. ..... 347/19

*Primary Examiner*—N. Le
*Assistant Examiner*—Anh T. N. Vo
*Attorney, Agent, or Firm*—Sughrue, Mion, Zinn Macpeak & Seas, PLLC

[57] ABSTRACT

The improved thermal recording apparatus for forming an image in accordance with image data on a thermal recording material using a thermal head comprises a correction data storage unit for holding shading correction data for the image data and at least one of weighting functions for performing weighting on a coefficient of shading correction of the image data, and an image processing unit that weights the shading correction data on the basis of at least one of the weighting functions, that calculates the coefficient of the shading correction and which then performs at least the shading correction on the image data. The correction data storage unit holds at least one of the respective weighting functions of shading correction coefficient associated with a recording density of the image data, a temperature of the thermal head, a recording speed of the image, temperature and humidity of the thermal recording material and a gradient of the thermal recording material. This apparatus further comprises at least one of the temperature detector of the thermal head, the setting device of the recording speed, the temperature and humidity detectors of the thermal material and the storing device of the thermal material. This apparatus is capable of performing shading correction of image data in high precision.

8 Claims, 3 Drawing Sheets

THERMAL RECORDING APPARATUS

BACKGROUND OF THE INVENTION

This invention relates to a thermal recording apparatus with which an image corresponding to image data is formed on a thermal recording material (hereunder referred to as a "thermal material") using a thermal head.

Thermal materials such as thermal films comprising a thermal recording layer on a film substrate are commonly used to record images produced in diagnosis by ultrasonic scanning. This recording method eliminates the need for wet processing and offers several advantages including convenience in handling. Hence, the use of the thermal image recording system is not limited to small-scale applications such as diagnosis by ultrasonic scanning and an extension to those areas of medical diagnoses such as CT, MRI and X-ray photography where large and high-quality images are required is under review.

As is well known, the thermal recording apparatus uses the thermal head having a glaze in which heat generating resistors corresponding to the number of pixels of one line are arranged in one direction and, with the glaze a little pressed against the thermal recording layer of the thermal material, the thermal material is relatively moved in a direction approximately perpendicular to the direction in which the heat generating resistors are arranged, and the respective heat generating resistors of the glaze are heated in accordance with the image data to be recorded to heat the thermal recording layer imagewise, thereby accomplishing image reproduction.

When image recording is effected using specified image data of the same recording density, the image formed has unevenness in the recording density due to the thermal head. Termed "shading", this unevenness in density is generally such that the density is the highest in the image area corresponding to the center of the thermal head in which the glaze extends and it decreases gradually toward either end of the image. In order to solve this problem of uneven density, shading correction is commonly performed in thermal recording.

To realize shading correction, the following procedure is taken: an image is recorded using specified image data of the same recording density; the density of the recorded image is measured by an optical means such as a densitometer, whereby shading correction data which corrects the image data in such a way that the image to be recorded will have a uniform density is calculated on the basis of both the recording density of the image data which is to be delivered from the thermal recording apparatus and the actually measured density of the recorded image; and the data of the image to be recorded is corrected using the thus calculated shading correction data.

Since the shading generally occurs due to the thermal head in the thermal recording apparatus, the originating site of uneven densities is not variable; however, the intensity of density unevenness varies with many factors such as the recording density of image data, the temperature of the thermal head, the image recording speed (the transport speed of the thermal material relative to the thermal head), the temperature and humidity of the thermal material and its gradient. Therefore, it is difficult to achieve shading correction in high precision.

To mention one example, the recorded images become more uneven in density if the temperature of the thermal head or the image recording speed increases.

This reduction in the precision of shading correction results in the deterioration of the quality of finished images and, particularly in medical areas where high-quality images need be recorded, the defect can potentially cause a serious problem by leading to a wrong diagnosis.

SUMMARY OF THE INVENTION

The present invention has been accomplished under these circumstances and has as an object providing a thermal recording apparatus that is capable of performing shading correction of image data in high precision regardless of the recording density of the image data, the temperature of the thermal head, the image recording speed, the temperature and humidity of the thermal material and its gradient.

To achieve the above object, the invention provides a thermal recording apparatus for forming an image in accordance with image data on a thermal recording material using a thermal head;

said apparatus having a correction data storage unit for holding shading correction data for said image data and at least one of weighting functions for performing weighting on a coefficient of shading correction of said image data, and an image processing unit that weights said shading correction data on the basis of said at least one of the weighting functions, that calculates the coefficient of said shading correction and which then performs at least said shading correction on said image data; wherein said correction data storage unit holds said at least one of the respective weighting functions of shading correction coefficient associated with a recording density of said image data, a temperature of said thermal head, a recording speed of said image, temperature and humidity of said thermal recording material and a gradient of said thermal recording material; and wherein said apparatus further comprises at least one of means of detecting the temperature of said thermal head, means of setting the recording speed of said image, means of detecting the temperature and humidity of said thermal recording material and means of storing the gradient of said thermal recording material, when said correction data storage unit holds said at least one of the respective weighting functions of shading correction coefficient associated with the temperature of said thermal head, the recording speed of said image, the temperature and humidity of said thermal recording material and the gradient of said thermal recording material.

It is preferred that in said thermal recording apparatus, said at least one of the weighting functions held in said correction data storage unit is the weighting function of the shading correction coefficient associated with the temperature of said thermal head.

It is also preferred that said at least one of the weighting functions held in said correction data storage unit is the weighting function of the shading correction coefficient associated with the temperature of said thermal head, as well as at least one of the respective weighting functions of the shading correction coefficient associated with the recording speed of said image, the temperature and humidity of said thermal recording material and the gradient of said thermal recording material.

The present invention will now be described in detail.

In the thermal recording apparatus of the invention, shading correction data, as well as at least one of weighting functions (or weighting tables) of shading correction coefficient that are respectively associated with the recording density of the image data, the temperature of the thermal head, the image recording speed, the temperature and humidity (hereunder referred to briefly as temperature/humidity) of the thermal material and its gradient are held in the correction data storage unit, and shading correction coefficients are calculated in the image processing unit by weighting the shading correction data for the image data in accordance with the recording density of the image data, the temperature of the thermal head, the image recording speed, the temperature/humidity of the thermal material and its gradient, and the individual image data are corrected for shading using the thus calculated coefficients.

In the correction data storage unit, at least one of the weighting functions of shading correction coefficient associated with the recording density of the image data, the temperature of the thermal head, the image recording speed, the temperature/humidity of the thermal material and its gradient is held and, preferably, the weighting function of shading correction coefficient associated with the temperature of the thermal head is held in the correction data storage unit.

When anyone of the respective weighting functions of shading correction coefficient associated with the temperature of the thermal head, the image recording speed, the temperature/humidity of the thermal material and its gradient is to be held in the correction data storage unit, the thermal recording apparatus must comprise accordingly anyone of means of detecting the temperature of the thermal head, means of setting the image recording speed, means of detecting the temperature/humidity of the thermal recording material and means of storing the gradient of the thermal recording material.

DETAILED DESCRIPTION OF THE INVENTION

The thermal recording apparatus of the invention will now be described in detail with reference to the preferred embodiments shown in the accompanying drawings.

Figure 1:
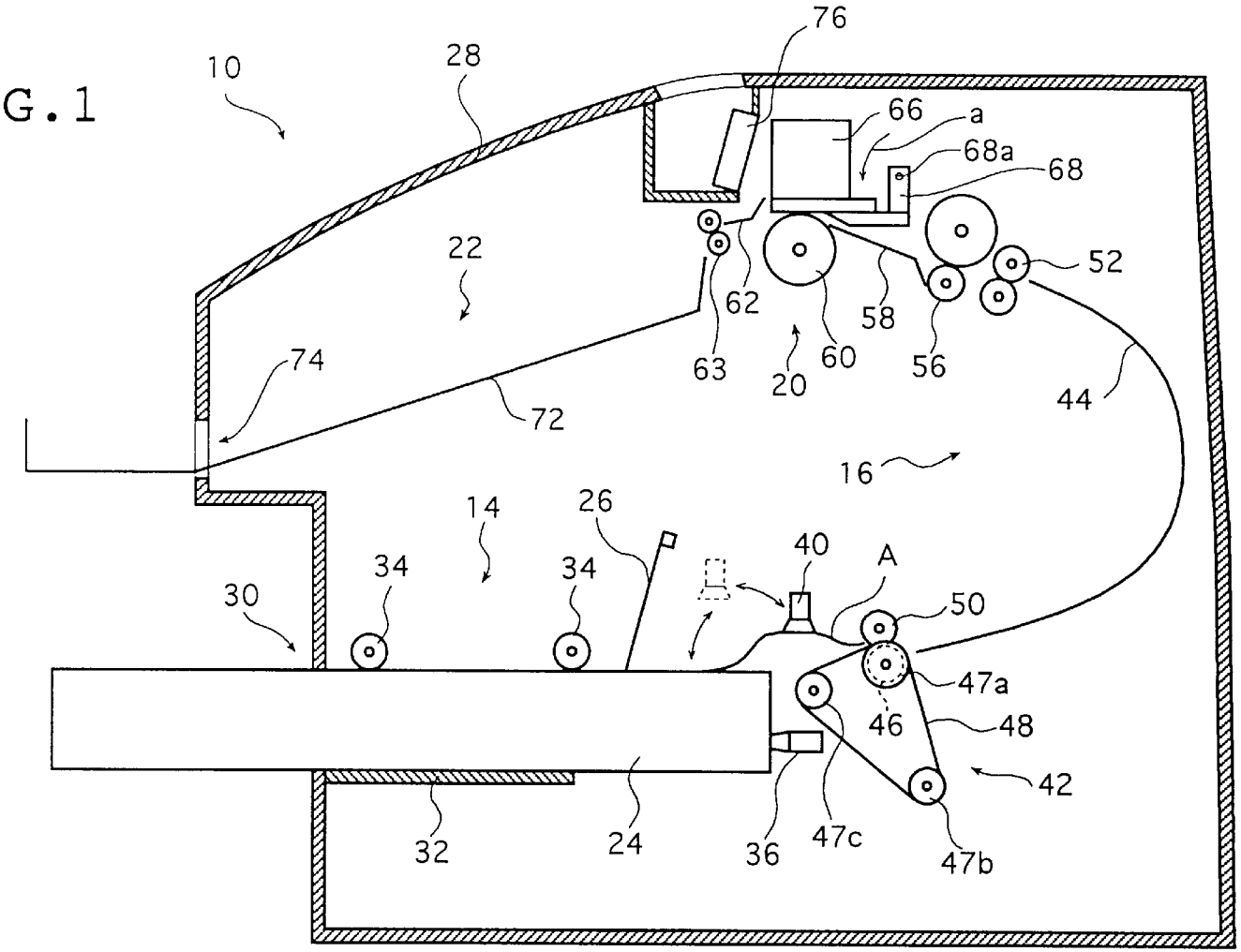
FIG. 1 is a diagram showing the concept of an example of the thermal recording apparatus of the invention.

FIG. 1 shows schematically an example of the thermal recording apparatus of the invention. The thermal recording apparatus generally indicated by 10 in FIG. 1 and which is hereunder simply referred to as a "recording apparatus" performs thermal recording on thermal films of a given size, say, B4 (namely, thermal films in the form of cut sheets). The apparatus comprises a loading section 14 where a magazine 24 containing thermal films A is loaded, a feed/transport section 16, a recording section 20 performing thermal recording on thermal films A by means of the thermal head 66, and an ejecting section 22.

The thermal films A comprise respectively a substrate consisting of a transparent film such as a transparent polyethylene terephthalate (PET) film, which is overlaid with a thermal recording layer. Typically, such thermal films A are stacked in a specified number, say, 100 to form a bundle, which is either wrapped in a bag or bound with a band to provide a package. As shown, the specified number of thermal films A bundled together with the thermal recording layer side facing down are accommodated in the magazine 24 of the recording apparatus 10, and they are taken out of the magazine 24 one by one to be used for thermal recording.

The loading section 14 has an inlet 30 formed in the housing 28 of the recording apparatus 10, a guide plate 32, guide rolls 34 and a stop member 36.

The magazine 24 is a case having a cover 26 which can be freely opened, and is inserted into the recording apparatus 10 via the inlet 30 of the loading section 14 in such a way that the portion fitted with the cover 26 is coming first; thereafter, the magazine 24 as it is guided by the guide plate 32 and the guide rolls 34 is pushed until it contacts the stop member 36, whereupon it is loaded at a specified position in the recording apparatus 10.

The feed/transport section 16 has the sheet feeding mechanism using the sucker 40 for grabbing the thermal film A by application of suction, transport means 42, a transport guide 44 and a regulating roller pair 52 located in the outlet of the transport guide 44; the thermal films A are taken out of the magazine 24 in the loading section 14 and transported to the recording section 20.

The transport means 42 is composed of a transport roller 46, a pulley 47*a* coaxial with the roller 46, a pulley 47*a* coupled to a rotating drive source, a tension pulley 47*c*, an endless belt 48 stretched between the three pulleys 47*a*, 47*a* and 47*c*, and a nip roller 50 that is to be pressed onto the transport roller 46.

When a signal for the start of recording is issued, the cover 26 is opened by the OPEN/CLOSE mechanism (not shown) in the recording apparatus 10. Then, the sheet feeding mechanism using the sucker 40 picks up one sheet of thermal film A from the magazine 24 and feeds the forward end of the sheet to the transport means 42 (to the nip between rollers 46 and 50).

At the point of time when the thermal film A has been pinched between the transport roller 46 and the nip roller 50, the sucker 40 releases the film, and the thus fed thermal film A is supplied along the transport guide 44.

At the point of time when the thermal film A to be used in recording has been completely ejected from the magazine 24, the OPEN/CLOSE mechanism closes the cover 26. The distance between the transport means 42 and the regulating roller pair 52 which is defined by the transport guide 44 is set to be somewhat shorter than the length of the thermal film A in the direction of its transport. The advancing end of the thermal film A first reaches the regulating roller pair 52 by the transport means 42. The regulating roller pair 52 are normally at rest. The advancing end of the thermal film A stops here.

When the advancing end of the thermal film A reaches the regulating roller pair 52, the temperature of the thermal head 66 is checked and if it is at a specified level, the regulating roller pair 52 start to transport the thermal film A, which is transported to the recording section 20.

Figure 2:
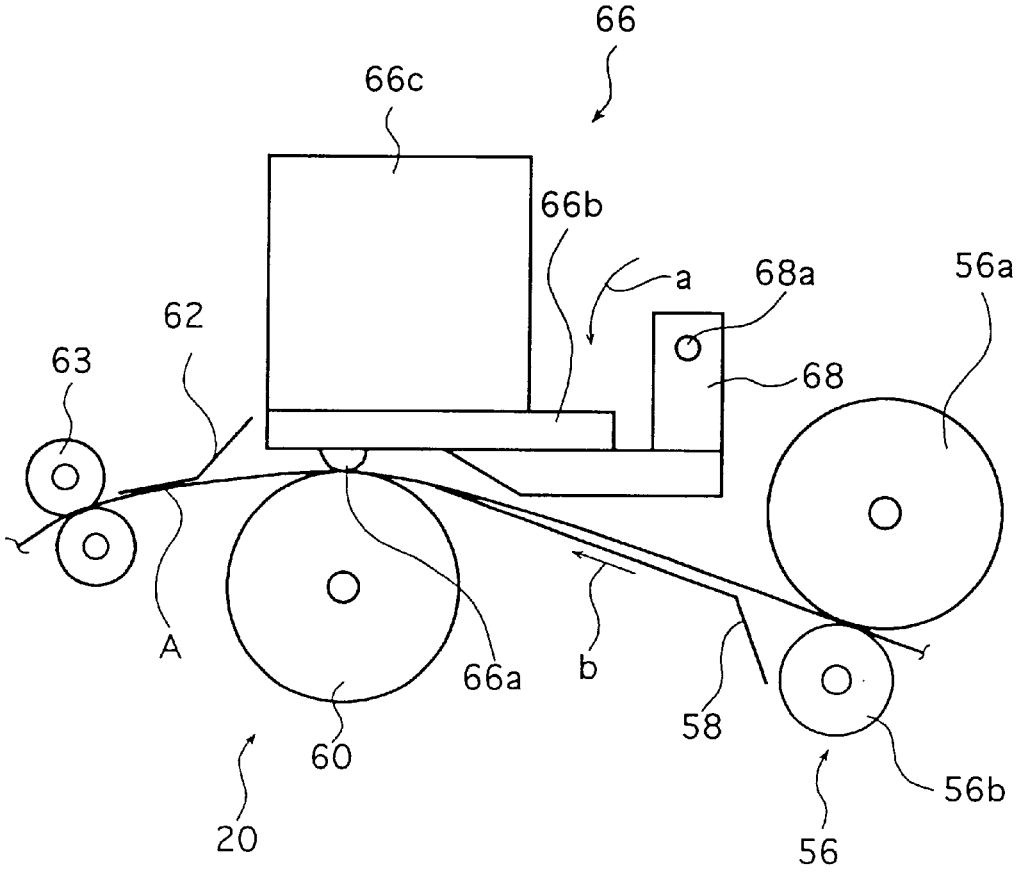
FIG. 2 is a diagram showing the concept of an example of the recording section of the thermal recording apparatus shown in FIG. 1.

FIG. 2 shows schematically the recording section 20. As shown, the recording section 20 has the thermal head 66, a platen roller 60, a cleaning roller pair 56, a guide 58, a fan 76 for cooling the thermal head 66 (see FIG. 1, not shown in FIG. 2), a guide 62, and a transport roller pair 63.

As shown, the thermal head 66 is capable of thermal recording at a recording (pixel) density of, say, about 300 dpi on the thermal films of a given size, for example, B4. The head comprises a thermal head body 66*b* having a glaze 66*a* in which the heat generating resistors performing one line thermal recording on the thermal film A are arranged in one direction (perpendicular to the paper of FIG. 2), and a heat sink 66*c* fixed to the thermal head body 66*b*. The thermal head 66 is supported on a support member 68 that can pivot about a fulcrum 68*a* either in the direction of arrow a or in the reverse direction.

The platen roller 60 rotates at a specified image recording speed while holding the thermal film A in a specified position, and transports the thermal film A in the direction (direction of arrow b in FIG. 2) approximately perpendicular to the direction in which the glaze 66*a* extends.

The cleaning roller pair 56 comprises a sticky rubber roller 56*a* and a non-sticky roller 56*b*.

Before the thermal film A is transported to the recording section 20, the support member 68 has pivoted to UP position (in the direction opposite to the direction of arrow a) so that the glaze 66*a* of the thermal head 66 is not in contact with the platen roller 60.

When the transport of the thermal film A by the regulating roller pair 52 starts, said film A is subsequently pinched between the cleaning roller pair 56 and transported as it is guided by the guide 58.

When the advancing end of the thermal film A has reached the record START position (i.e., corresponding to the glaze 66*a*), the support member 68 pivots in the direction of arrow a and the thermal film A becomes pinched between the glaze 66*a* on the thermal head 66 and the platen roller 60 such that the glaze 66*a* is pressed onto the recording layer while the thermal film A is transported in the direction of arrow b by means of the platen roller 60, the regulating roller pair 52 and the transport roller pair 63 as it is held in a specified position by the platen roller 60.

During this transport, the individual heat generating resistors on the glaze 66*a* are actuated in accordance with the image data of the image to be recorded to perform image-wise thermal recording on the thermal film A.

In the thermal recording apparatus of the invention, this operation of thermal recording in accordance with the data of the image to be recorded is performed by an image data processing system, which is described specifically below.

Figure 3:
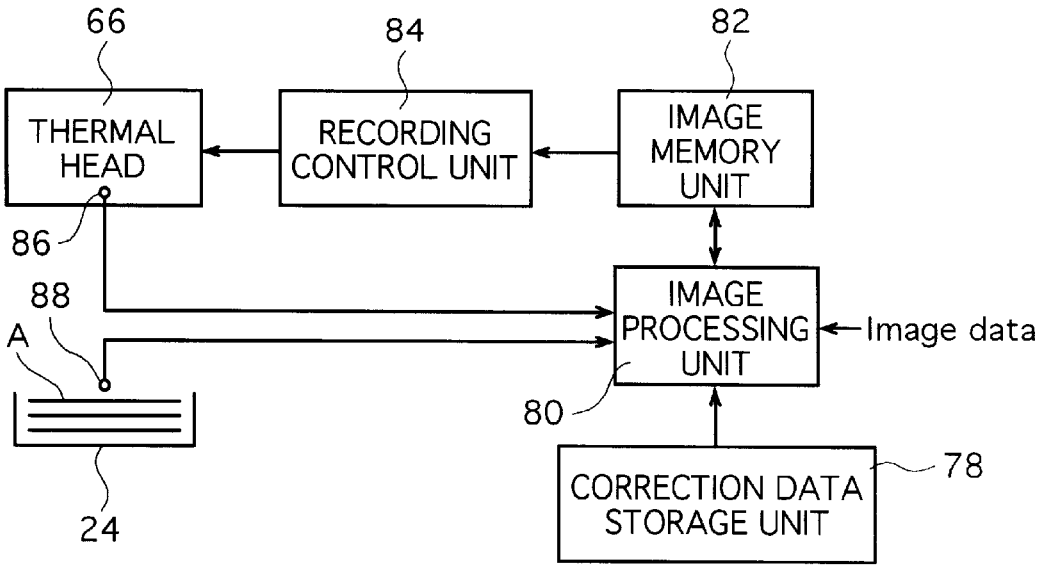
FIG. 3 is a block diagram showing the concept of an example of the image data processing system of the thermal recording apparatus of the invention.

FIG. 3 is a diagram showing the concept of an example of the image data processing system. The illustrated system comprises a correction data storage unit 78 for holding various kinds of image correction data, an image processing unit 80 which performs shading correction and various other corrections on the image data, an image memory 82 for holding the corrected image data, and a recording control unit 84 which controls the thermal head 66 on the basis of the image data held in the image memory 82.

Speaking first of the correction data storage unit 78, it holds weighting functions which weight the shading correction data in accordance with the recording density of the image data, the temperature of the thermal head 66, the image recording speed, the temperature/humidity of the thermal film A, and its gradient, as well as the shading correction data for the image data. The term "weighting functions" as used herein include not only functions described by mathematical equations or graphs but also weighting tables which tabulate the values of such functions.

Consider, for example, the weighting function of shading correction coefficient associated with the recording density of the image data. This is for calculating a shading correction coefficient in consideration of the degree by which the recording density of the image data will affect the unevenness of the density of a recorded image, and it is prepared by measuring a density of the actually recorded image for each of the recording densities of the image data to be delivered from the thermal recording apparatus.

Figure 4:
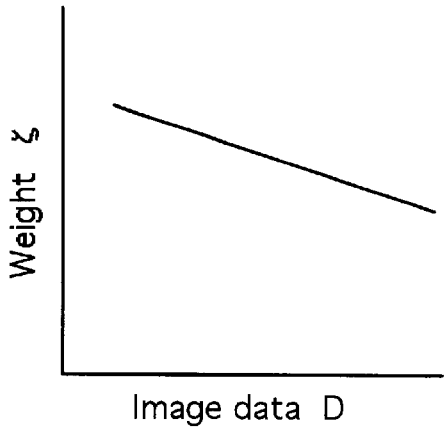
FIG. 4 is a graph showing one of the weighting functions of shading correction coefficient.

FIG. 4 is a graph showing the weighting function of shading correction coefficient associated with the recording density of the image data. The horizontal axis of the graph plots image data D representing the range of recording densities to be adopted by the recording apparatus 10 and the vertical axis plots weight values $\zeta$ corresponding to specific values of the image data D. The weighting function can be used to calculate the weight value $\zeta(D(N))$ corresponding to the recording density of the image data D(N) of the Nth pixel.

The same theory applies to the weighting functions of shading correction coefficient associated with the temperature of the thermal head 66, the image recording speed, the temperature/humidity of the thermal film A and its gradient and these weighting functions can be prepared by entirely the same method as with the shading correction coefficient associated with the recording density of the image data.

The shading compensation data are calculated by the following procedure. First, the temperature of the thermal head 66, the image recording speed, the temperature/humidity of the thermal film A and its gradient are set at appropriate values; then, an image is recorded using specified image data of the same recording density and the density of the recorded image is measured optically, and on the basis of both the recording density of image data to be delivered from the thermal recording apparatus and the actually measured density of the recorded image, the shading correction data are calculated in such a way that the image data can be corrected to ensure that the images to be recorded under identical conditions will have uniform densities.

Then, the image processing unit 80 is supplied with image data from an image supply source such as CT or MRI.

In accordance with the temperature of the thermal head 66, the image recording speed, the temperature/humidity of the thermal film A, its gradient and the recording density of the image data, the image processing unit 80 corrects the image data for shading on the basis of the associated weighting functions and shading correction data within the correcting data storage unit 78 by means of the following expressions:

$$D'(N)=D(N)\times(1-K)$$

$$K=\alpha\times\beta\times\gamma\times\delta\times\zeta(D(N))\times S(N)$$

where N is the pixel number of the glaze on the thermal head 66; D' (N) is the image data of the Nth pixel after shading correction; D(N) is the image data of the Nth pixel before shading correction; K is the shading correction coefficient; $\alpha$ is the weight value for the temperature of the thermal head 66; $\beta$ is the weight value for the image recording speed; $\gamma$ is the weight value for the temperature/humidity of the thermal film A; $\delta$ is the weight value for the gradient of the thermal film A; $\zeta(D(N))$ is the weight value for the recording density of the image data of the Nth pixel D(N); S(N) is the shading correction data of the Nth pixel.

The temperature of the thermal head 66 can be typically detected by thermal head temperature detecting means 86 such as a thermistor; similarly, the temperature/humidity of the thermal film A may be detected by a temperature/humidity detecting means in the magazine (or tray) 24 containing the thermal film A. In the embodiment under consideration, the interior of the magazine 24 is humidified to have a specified constant humidity and only the temperature of the thermal film A is detected by a temperature detecting means 88 in the magazine 24

The image recording speed may be obtained by means for setting the speed at which the thermal film A is transported in the thermal recording apparatus. Alternatively, means for retaining the transport speed of the thermal film A at an appropriate level may be provided. The gradient of the thermal film A is preferably set by means for storing the gradient of the thermal film A.

In addition to the correction of image data for shading, the image processing unit 80 performs various other kinds of image processing such as sharpness correction for enhancing the edge of the image, gradient compensation for effecting correction in accordance with the γ-value of the thermal film A, temperature compensation for adjusting the energy of heat generation in accordance with the temperature of heat generating resistors, resistance correction for correcting the difference between the resistances of adjacent heat generating resistors and black ratio compensation for correcting the unevenness in the image data of the same recording density that occurs due to the black ratio, and the corrected image data are stored in the image memory 82.

Subsequently, on the basis of the corrected image data stored in the image memory 82, the recording control unit 84 controls the heat generation of the individual heat generating resistors that compose the glaze on the thermal head 66 and which have one-to-one correspondence to the respective pixels of one line and, as a result, a desired image is recorded.

After the end of thermal recording, the thermal film A as it is guided by the guide 62 is transported by the platen roller 60 and the transport roller pair 63 to be ejected into a tray 72 in the ejecting section 22. The tray 72 projects exterior to the recording apparatus 10 via the outlet 74 formed in the housing 28 and the thermal film A carrying the recorded image is ejected via the outlet 74 for takeout by the operator.

The thermal recording apparatus of the invention is in no way limited to the above-stated embodiments and various improvements and modifications can of course be made without departing from the spirit and scope of the invention.

In the embodiment described above, the temperature of the thermal head 66, the image recording speed, the temperature/humidity of the thermal film A, its gradient and the recording density of the image data are all employed to ensure that shading correction is achieved in high precision. Needless to say, the thermal recording apparatus of the invention is capable of satisfactory improvement in the precision of shading correction even if just one of the five parameters mentioned above is employed to perform shading correction.

Among the five parameters mentioned above, at least the temperature of the thermal head 66 should preferably be included as the basis for shading correction. More preferably, the temperature of the thermal head 66 is combined with at least one of the other parameters, i.e., the image recording speed, the temperature/humidity of the thermal film A, its gradient and the recording density of the image data, for performing shading correction.

As described above in detail, the thermal recording apparatus of the invention is adapted to be such that shading correction coefficients are calculated by weighting the shading correction data for the image data in accordance with the recording density of the image data, the temperature of the thermal head, the image recording speed, the temperature/humidity of the thermal material and its gradient and that the individual image data are corrected for shading using the thus calculated coefficients.

Hence, by using the thermal recording apparatus of the invention, one can ensure that regardless of the recording density of the image data, the temperature of the thermal head, the image recording speed, the temperature/humidity of the thermal material and its gradient, the image to be recorded is corrected for shading in high precision to thereby achieve consistent recording of high-quality images without uneven densities.

What is claimed is:

1. A thermal recording apparatus for forming an image in accordance with image data on a thermal recording material using a thermal head; said apparatus comprising:

a correction data storage unit for holding shading correction data for said image data for correcting an unevenness in a recording density due to said thermal head and at least one of: a weighting function for a shading correction coefficient associated with the recording density of said image data, a weighting function for a shading correction coefficient associated with a temperature of said thermal head, a weighting function for a shading correction coefficient associated with a recording speed of said image, a weighting function for a shading correction coefficient associated with a temperature and a humidity of said thermal recording material, and a weighting function for a shading correction coefficient associated with a gradient of said thermal recording material;

an image processing unit for correcting the unevenness in the recording density due to said thermal head by calculating an applied shading correction coefficient based on said at least one of the weighting functions, and then applying said applied shading correction coefficient to said image data; wherein said apparatus further comprises at least one of means for detecting the temperature of said thermal head, means for setting the recording speed of said image, means for detecting the temperature and the humidity of said thermal recording material and means for storing the gradient of said thermal recording material, said at least one of detecting and storing means outputting a signal to said correction data storage unit for determining said respective weighting functions.

2. A thermal recording apparatus according to claim 1, wherein the weighting function for the shading correction coefficient associated with the temperature of said thermal head is held in said correction data storage unit.

3. A thermal recording apparatus according to claim 1, wherein the weighting function for the shading correction coefficient associated with the temperature of said thermal head, as well as at least one of the weighting function for the shading correction coefficient associated with the recording speed of said image, the weighting function for the shading correction coefficient associated with the temperature and the humidity of said thermal recording material, and the weighting function for the shading correction coefficient associated with the gradient of said thermal recording material is held in said correction data storage unit.

4. A thermal recording apparatus according to claim 1, wherein the weighting function for the shading correction coefficient associated with the temperature and the humidity of said thermal recording material is held in said correction data storage unit.

5. A thermal recording apparatus according to claim 1, wherein the weighting function for the shading correction coefficient associated with the gradient of said thermal recording material is held in said correction data storage unit.

6. A thermal recording apparatus according to claim 1, wherein each of the weighting function for the shading correction coefficient associated with the recording density of said image data, the weighting function for the shading correction coefficient associated with the temperature of said thermal head, the weighting function for the shading correction coefficient associated with the recording speed of said image, the weighting function for the shading correction coefficient associated with the temperature and the humidity of said thermal recording material, and the weighting function for the shading correction coefficient associated with the gradient of said thermal recording material is held in said correction data storage unit; and wherein said image processing unit calculates the applied shading correction coefficient based on all of the weighting functions and then applies said applied shading correction coefficient to said image data.

7. A thermal recording apparatus for recording an image in accordance with image data using a thermal head composed of a plurality of recording elements, comprising:

a correction data storage unit for holding shading correction data which represents relative quantity of shading correction between said recording elements for correcting an unevenness in a recording density of said image recorded in accordance with said image data using said thermal head and at least one weighting function for performing weighting on said shading correction data, and an image processing unit which corrects the unevenness in the recording density by weighting an applied shading correction data based on said at least one weighting function to calculate a coefficient of shading correction to be applied and then performing shading correction on said image data based on the thus calculated coefficient of shading correction.

8. The thermal recording apparatus according to claim 7, wherein said shading correction data is data which is calculated from specified image data having uniform density and an actual measured density of a recorded image corresponding to said specified image data so as to correct the image data so that a density of a corrected recorded image corresponding to said specified image data is uniform, and wherein said actual measured density is measured optically.

* * * * *